US011723451B1

(12) United States Patent
Boccard

(10) Patent No.: US 11,723,451 B1
(45) Date of Patent: Aug. 15, 2023

(54) HAIRBRUSH WITH HAIR TIE STORAGE

(71) Applicant: Vincent Boccard, Coral Springs, FL (US)

(72) Inventor: Vincent Boccard, Coral Springs, FL (US)

( * ) Notice: Subject to any disclaimer, the term of this patent is extended or adjusted under 35 U.S.C. 154(b) by 0 days.

(21) Appl. No.: 17/870,952

(22) Filed: Jul. 22, 2022

(51) Int. Cl.

| | |
|---|---|
| ***A46B 15/00*** | (2006.01) |
| ***A45D 44/00*** | (2006.01) |
| ***A46B 5/00*** | (2006.01) |
| ***A46B 9/02*** | (2006.01) |

(52) U.S. Cl.
CPC ..... *A46B 15/0061* (2013.01); *A45D 44/00* (2013.01); *A46B 5/00* (2013.01); *A46B 9/023* (2013.01); *A46B 2200/104* (2013.01)

(58) Field of Classification Search
CPC .... A45D 2200/25; A45D 24/10; A45D 24/02; A45D 8/36; A46B 15/0061; B65D 3/18; B65D 63/109
See application file for complete search history.

(56) References Cited

U.S. PATENT DOCUMENTS

| | | | | |
|---|---|---|---|---|
| 4,308,878 | A * | 1/1982 | Silva | A45D 1/00 219/242 |
| 9,615,653 | B1 * | 4/2017 | Anderson | A46B 15/0055 |
| 10,244,856 | B1 * | 4/2019 | Horsky | A46B 7/042 |
| 2018/0213925 | A1 * | 8/2018 | Hall | A46B 9/023 |
| 2021/0100331 | A1 | 4/2021 | Lomack | |

* cited by examiner

*Primary Examiner* — Rachel R Steitz
*Assistant Examiner* — Brianne E Kalach
(74) *Attorney, Agent, or Firm* — Sanchelima & Associates, P.A.; Christian Sanchelima; Jesus Sanchelima

(57) ABSTRACT

A hairbrush with hair-tie storage including a brush assembly, a handle assembly and a hair-tie assembly. The brush assembly includes a head brush with bristles. The handle assembly includes a handle extending from a bottom portion of the brush. The handle assembly further includes a first cut and a second cut defining a storage portion. The storage portion includes a curvature in a mirrored configuration. The storage portion allows storing the hair-tie assembly thereon. The storage portion further includes stopper members to secure the hair-tie to the storage portion.

6 Claims, 5 Drawing Sheets

HAIRBRUSH WITH HAIR TIE STORAGE

BACKGROUND OF THE INVENTION

1. Field of the Invention

The present invention relates to hairbrushes with hair-tie storage and, more particularly, to a hairbrush with hair-tie storage that includes a handle having a hair-tie storage.

2. Description of the Related Art

Several designs for hairbrush with hair-tie storage have been designed in the past. None of them, however, include a hairbrush with hair-tie storage that includes a handle having cuts to store hair-ties.

Applicant believes that a related reference corresponds to U.S. patent No. US20180213925A1 issued for a hairbrush with accessory holding handle for storing and transporting small accessories. Applicant believes that another related reference corresponds to U.S. patent No. US20210100331A1 issued for a barber hair comb with section to attach elastic band. None of these references, however, teach of a hairbrush with hair-tie storage that includes a handle having a first and second cut defining a curvature in mirrored configuration to store hair-ties thereon.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a hairbrush with hair-tie storage that includes a handle having a storage portion to easily storing hair-ties.

It is another object of this invention to provide a hairbrush with hair-tie storage that includes stopper members to secure the hair-ties to the It is still another object of the present invention to provide a hairbrush with hair-tie storage that can allow having easy access to hair-ties when combing the hair with the hairbrush.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
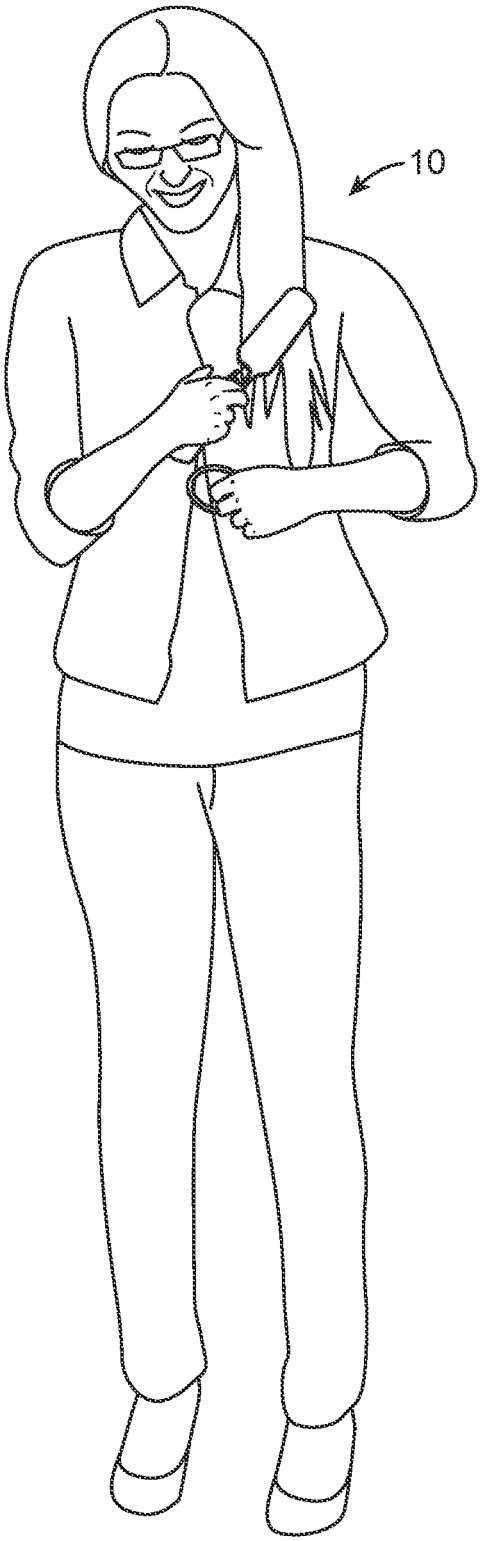
FIG. 1 represents an isometric operational view of the present invention 10. The user is grabbing one of hair tie from the handle assembly 40.
Figure 2:
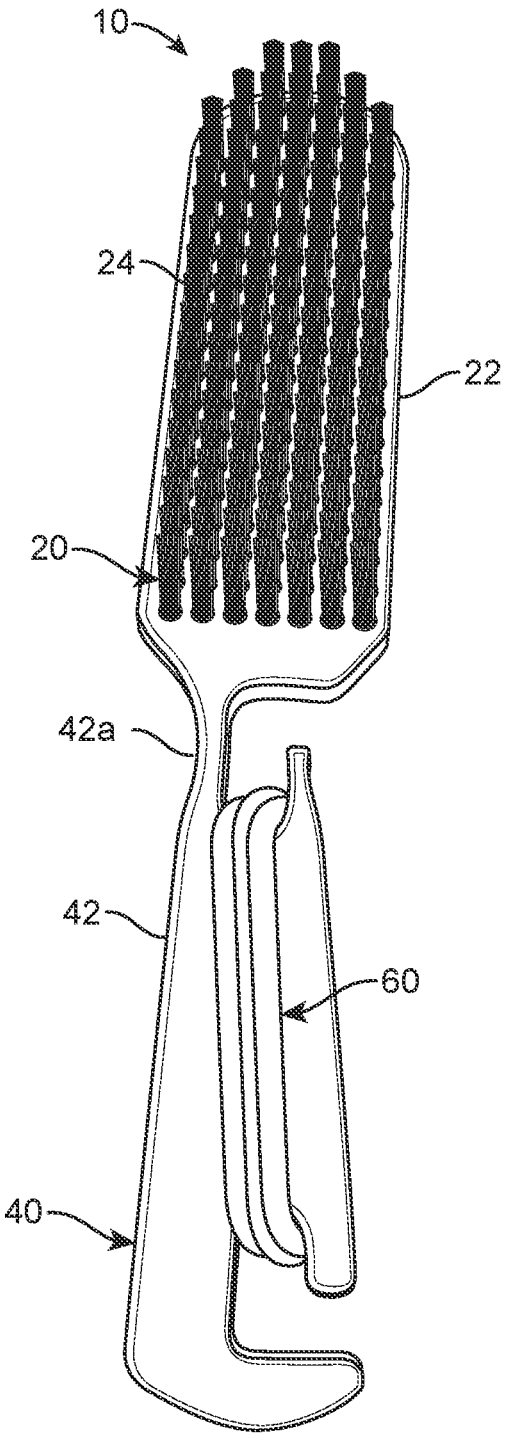
FIG. 2 shows an isometric view of one of the preferred embodiments the present invention 10. The neck 22*a* connects the handle assembly 20 to the brush assembly 40.
Figure 2A:
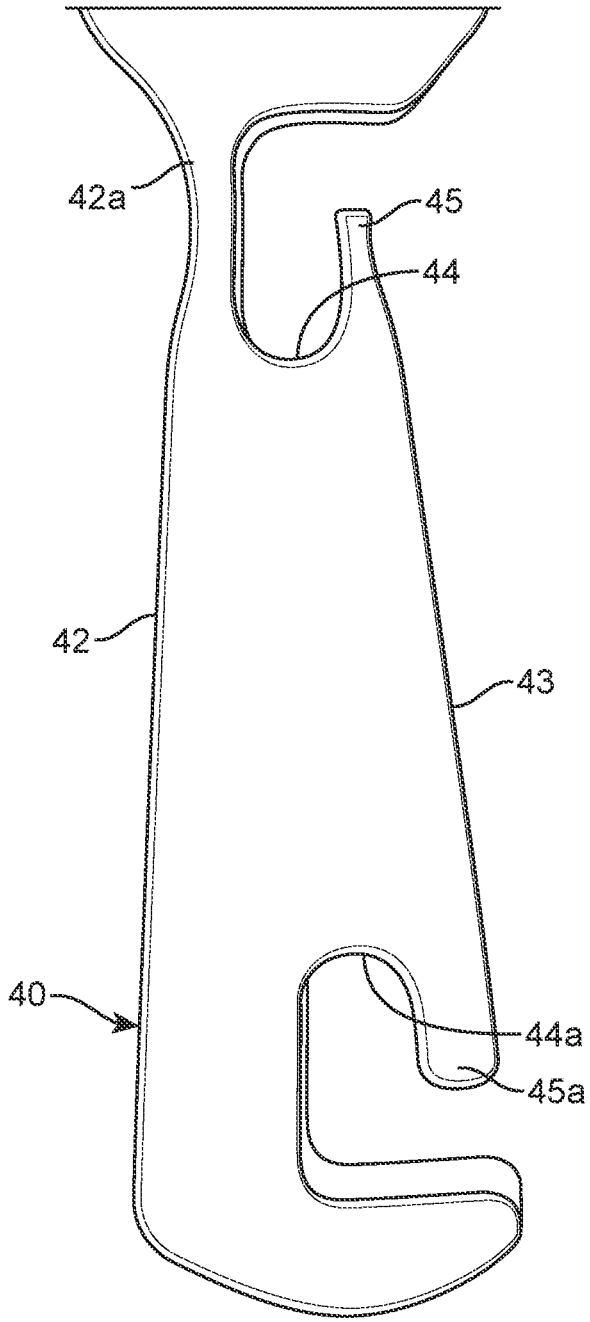
FIG. 2A is an enlarged view of the handle assembly 40 showing the storing portion 44.

Referring now to the drawings, where the present invention is generally referred to with numeral 10, it can be observed that it basically includes a brush assembly 20 and a handle assembly 40. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The brush assembly 20 may include a head 22 and bristles 24. In one embodiment, the head 22 may have lateral sides being planar. It also may be suitable to have the lateral sides having other shapes such as curved shape, triangular shape, irregular shape, or any other suitable shape. The head 22 may have an upper portion having a curved shape. The upper portion of the head 22 may have a semicircular shape. It should be understood that the upper portion of the head 22 may have other shapes such as a planar shape, a triangular shape, a trapezium shape, an irregular shape or any variation thereof. A bottom portion of the head 22 may taper inwardly. The planar lateral sides of the head 22 may be connected to the upper portion and to the bottom portion of the head 22 thereby defining a head 22 with a substantially elliptical shape. The head 22 may have a thickness. It should be understood that the head 22 may have any other suitable shape for a brush head as known in the prior art. In one embodiment, the head 22 may be made of wood. It also may be suitable to have the head 22 made of plastic, a composite or any other suitable material for a brush head.

The bristles 24 may be disposed on a front side of the head 22. The bristles 24 may be grouped and placed on the head 22. The bristles 24 may be made of nylon or any other suitable synthetic material for a bristle. It should be understood that other embodiments of the brush assembly 20 may include bristles 24 made of natural materials or a combination of natural and synthetic materials. The brush assembly 20 may be a round brush, vent brush, cushion brush, paddle brush, detangler bush, boar bristle brush, detangling brush, mixed bristle brush or any other kind of brush known in the prior art.

The handle assembly 40 may include handle 42 and a storing portion 44. The hand assembly may extend from a bottom portion of the brush assembly 40. In one embodiment, the handle 42 may have neck 42*a*. Neck 42*a* may extend from lower left portion of the head 22. Preferably the handle 42 and the head 22 may be integrally manufactured. It also may be suitable to have the handle 42 and the head manufactured as different elements that can be interchanged. The handle 42 may be made of wood, plastic or any other suitable material for a handle 42. The handle 42 may have a base wider than a top portion. The bottom portion of the handle 42 may have a rounded curved shape. The handle assembly 40 may include first cut 44 and second cut 44*a*. In one embodiment, the first cut 44 may be located on a top right portion of the handle. The second cut 44*a* may be located on a bottom right portion of the handle. The first cut 44 may be a cut from the right top portion of the handle to a top central portion of the handle and slightly downwards. The first cut 44 may have rounded corners.

The first cut 44 may define a first stopper 45. The second cut 44*a* may be a cut from the lower right portion of the handle towards a lower central portion and slightly upwards. The second cut 44*a* may define a second stopper 45*a*. The first cut 45 and the second cut 45*a* may include a curvature in a mirrored configuration one with respect to the other. The curvature in the mirror configuration of the first cut 45*a* and second cut 44*a* may define the storing portion 44. The storing portion 44 may be an integral portion of handle 42. The storing portion 44 may receive a hair-tie assembly 60 therein.

The hair-tie assembly 60 may have a circular shape. It should be understood that the hair-tie assembly 60 may have any other suitable shape. The hair-tie assembly 60 may be made of an elastic material. It should be understood that the hair-tie assembly 60 may be made of any suitable material. It should be understood that the hair-tie assembly 60 may be any suitable hair-tie known in the prior art. The hair-tie assembly 60 may be stored in the storing portion 44 so a user can easily have access to the hair-tie assembly 60 stored therein. It should be understood that the hair-tie assembly 60 may include any other suitable hair accessory. It should be noted that the storing portion 44 may store any other suitable hair accessory. The first stopper 45 and the second stopper 45*a* may allow securing the hair-tie assembly 60 to the storing portion 44 preventing the hair-tie assembly 60 from sliding.

Figure 3:
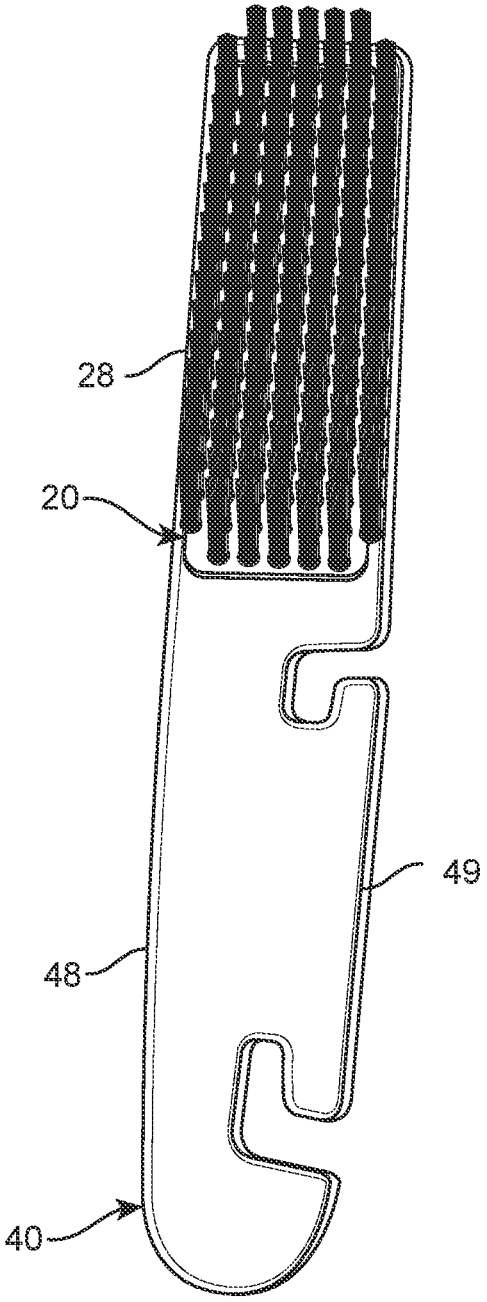
FIG. 3 illustrates an alternative embodiment of the handle assembly 40 showing alternative handle 48 and alternative head 28.
Figure 4:
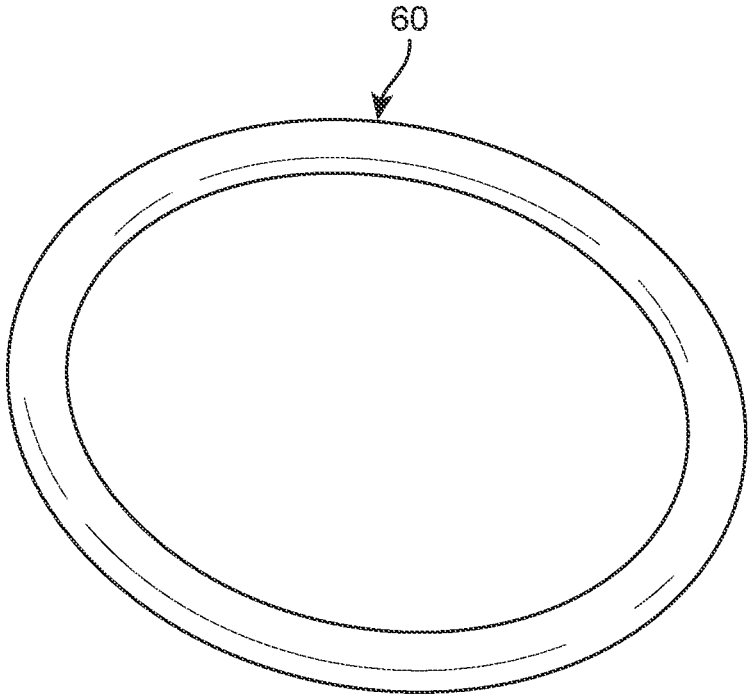
FIG. 4 is a representation of the hair-tie assembly 60.

Referring now to FIG. 3, it can be observed an alternative embodiment of the handle assembly 40 showing alternative handle 48. The alternative handle 48 may extend from a lower portion of alternative head 28 of one alternative embodiment of the brush assembly 20. In this embodiment the alternative head 28 may be substantially rectangular with rounded corners. The alternative handle 48 may extend from the alternative head 28. The alternative handle 48 may slightly tapers inwardly. The alternative handle 48 may have a rounded lower portion. The alternative handle 48 may have alternative storing portion 49 therein defined by cuts and flat mirrored portions. The alternative storing portion 49 may also include the stopper members. It should be understood that the present invention 10 may include any suitable handle, head and bristles as known in the prior art. It should be noted that any suitable handle may the storing portion 44 for storing hair-tie accessories therein.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A hairbrush with hair-tie storage, comprising:

A) a hair-tie assembly, wherein said hair-tie assembly includes a hair-tie having a circular shape, said hair-tie is elastic;

B) a brush assembly including a brush head with bristles, wherein said brush head has a rectangular shape with rounded corners; and C) a handle assembly including a neck portion and a handle extending from a bottom portion of the brush head, wherein said handle has a tapered shape defined by a bottom portion and a top portion, wherein said bottom portion has a slant transition to said top portion wherein a length of said neck is smaller than a length of a top end of said handle, said neck portion connects said brush head with said handle, the handle further including an upper cut out portion and a lower cut out portion, wherein the upper cut out portion and the lower cut out portion each include a curvature in a mirrored configuration with respect to one another, the curvature in the mirrored configuration facilitating storing a hair-tie assembly thereon, wherein said handle includes a first stopper and a second stopper to secure said hair-tie assembly to the upper cut out portion and the lower cut out portion, said lower cut out portion is a cut from the lower right portion of said handle towards a central portion and upwards, wherein said lower cut out portion extending upwards define said second stopper, wherein said second stopper substantially has a rectangular shape with rounded corners wherein said upper cut out portion is a cut from the right portion of said neck to a central portion of said neck and downwards, wherein said upper cut out portion extending downwards defines said first stopper, wherein said first stopper has a an elongated shape, the first stopper has a top distal end having a rectangular outline with rounded edges, said first stopper further has a bottom distal end which has a greater width than a width of said top distal end, said first stopper has a curved transition from said bottom distal end to said top distal end, wherein said lower cut out portion has a length that extends to the center of said handle, said upper cut out portion has a length that extends to the center of said neck wherein said first stopper and said second stopper are connected by a storing portion wherein said hair-tie is engaged to said first stopper and said second stopper in abutting contact with said storing portion, wherein said storing portion is an integral portion of said handle.

2. The hairbrush with hair-tie storage set forth in claim 1, wherein said brush head and said handle are made of wood.

3. The hairbrush with hair-tie storage set forth in claim 1, wherein said brush head and said handle are made of plastic.

4. The hairbrush with hair-tie storage set forth in claim 1, wherein said bristles are placed in a front portion of the brush head.

5. A hairbrush with hair-tie storage, consisting of:

A) a hair-tie assembly including a hair-tie having a circular shape, said hair tie is elastic;

B) a brush assembly including a brush head with bristles, wherein said brush head has a rectangular shape with rounded corners, wherein said brush head and said handle are made of plastic, wherein said bristles are placed in a front portion of the brush head; and C) a handle assembly including a handle extending from a bottom portion of the brush head, the handle further including an upper cut out portion, a neck portion and a lower cut out portion, wherein the upper cut out portion and the lower cut out portion each include a curvature in a mirrored configuration with respect to one another, the curvature in the mirrored configuration facilitating storing a hair-tie assembly thereon wherein said handle has a tapered shape defined by a bottom portion and a top portion, wherein said bottom portion has a slant transition to said top portion wherein a length of said neck is smaller than a length of a top end of said handle, said neck portion connects said brush head with said handle, wherein said lower cut out portion is a cut from the lower right portion of said handle towards a central portion and upwards, wherein said lower cut out portion extending upwards define a second stopper, wherein said second stopper substantially has a rectangular shape with rounded corners, wherein said upper cut out portion is a cut from the right portion of said neck to a central portion of said neck and downwards, wherein said upper cut out portion extending downwards defines a first stopper, wherein said first stopper has a an elongated shape, the first stopper has a top distal end having a rectangular outline with rounded edges, said first stopper further has a bottom distal end which has a greater width than a width of said top distal end, said first stopper has a curved transition from said bottom distal end to said top distal end wherein said lower cut out portion has a length that extends to the center of said handle, said upper cut out portion has a length that extends to the center of said neck, wherein said first stopper and said second stopper are connected by a storing portion, wherein said hair-tie is engaged to said first stopper and said second stopper in abutting contact with said storing portion, wherein said storing portion is an integral portion of said handle wherein said hair-tie is engaged to said first stopper and said second stopper.

6. A hairbrush with hair-tie storage, comprising:

a hair-tie assembly, wherein said hair-tie assembly includes a hair-tie having a circular shape, said hair-tie is elastic;

a brush assembly including a brush head with bristles, wherein said brush head has a rectangular shape with rounded corners, the brush head having a width; and a handle extending directly from a bottom portion of the brush head, the handle comprising a top end extending downward to an opposing free distal end along a central longitudinal axis, the handle defined by opposing lateral sides defining a width of the handle along a lateral axis;

a first cutout located proximal the top end of the handle and extending laterally inward from a first lateral side of the handle;

a second cutout located proximate the distal end of the handle and extending laterally inward from the first lateral side of the handle, wherein each cutout has at least a first and second length along the central longitudinal axis, where the first and second lengths are not equal, and where the length of each cutout is at a minimum proximate the first lateral side, wherein the cutouts are arranged such that the hair tie assembly is configured to be secured entirely within the lateral width of the handle by being seated simultaneously in each of the first and second cutouts.

* * * * *